US009863079B2

(12) United States Patent
Jang et al.

(10) Patent No.: US 9,863,079 B2
(45) Date of Patent: Jan. 9, 2018

(54) WASHING MACHINE HAVING A PLURALITY OF CONCENTRICALLY FORMED RECESSED PORTIONS ON THE TUB

(71) Applicant: SAMSUNG ELECTRONICS CO., LTD., Suwon-si, Gyeonggi-do (KR)

(72) Inventors: In Cheol Jang, Hwaseong-si (KR); Ji Sung Kim, Seongnam-si (KR); Eun Suk Bang, Hwaseong-si (KR); Nam Ki Sul, Suwon-si (KR); In Ju Lee, Yongin-si (KR); Seong Su Jeong, Ulsan (KR); Bong Wha Kwak, Hwaseong-si (KR); Doo Pil Kim, Suwon-si (KR); Ki Sun Park, Suwon-si (KR); Jong Sung Park, Seoul (KR); Ji Hoon Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

(21) Appl. No.: 14/050,582

(22) Filed: Oct. 10, 2013

(65) Prior Publication Data

US 2014/0096571 A1 Apr. 10, 2014

(30) Foreign Application Priority Data

Oct. 10, 2012 (KR) ..... 10-2012-0112682
Sep. 9, 2013 (KR) ..... 10-2013-0108121

(51) Int. Cl.
*D06F 37/26* (2006.01)
*D06F 37/02* (2006.01)
*D06F 37/06* (2006.01)

(52) U.S. Cl.
CPC ..... *D06F 37/26* (2013.01); *D06F 37/02* (2013.01); *D06F 37/06* (2013.01)

(58) Field of Classification Search
CPC ..... D06F 37/02; D06F 37/06; D06F 37/065; D06F 37/26; D06F 37/264
(Continued)

(56) References Cited

U.S. PATENT DOCUMENTS

2008/0202171 A1 8/2008 Park et al.
2010/0326142 A1 12/2010 Geyer et al.
2014/0096570 A1* 4/2014 Jang et al. ..... 68/142

FOREIGN PATENT DOCUMENTS

CN 1608157 4/2005
CN 101333746 12/2008
(Continued)

OTHER PUBLICATIONS

International Search Report dated Jan. 10, 2014 in corresponding International Application No. PCT/KR2013/008972.
(Continued)

*Primary Examiner* — Michael Barr
*Assistant Examiner* — Rita Adhlakha
(74) *Attorney, Agent, or Firm* — Staas & Halsey LLP

(57) ABSTRACT

A washing machine including a washing tub to allow enhancement in washing efficiency. A washing tub of the washing machine includes a pattern having a protrusion portion to generate friction force between laundry and the washing tub and to thereby increase washing efficiency. The pattern has a concave-convex structure and performs action similar to a lifter, washing efficiency may be enhanced using tumbling generated by the pattern. A plurality of drain holes are arranged in a certain pattern in the washing tub to prevent a dehydration bottleneck phenomenon in which dehydration is concentrated at a particular drain hole and to increase a dehydration rate. The pattern is provided such that
(Continued)

protrusion portions and recessed portions continue on the surface of the washing tub to enhance stiffness of the washing tub.

19 Claims, 17 Drawing Sheets

(58) Field of Classification Search
USPC ..... 68/142, 15, 212, 23.5, 23 R
See application file for complete search history.

(56) References Cited

FOREIGN PATENT DOCUMENTS

| | | |
|---|---|---|
| CN | 101946035 | 1/2011 |
| EP | 2 363 523 | 9/2011 |
| EP | 2 455 531 | 5/2012 |
| JP | 8-117485 | 5/1996 |
| JP | 2002-172296 | 6/2002 |
| WO | WO 03/054275 | 7/2003 |

OTHER PUBLICATIONS

European Search Report dated Nov. 27, 2013 in corresponding European Application No. 13188146.8.
Chinese Office Action dated Sep. 20, 2016 from Chinese Patent Application No. 201310470509.8, 19 pages.
Chinese Office Action dated Mar. 31, 2017 from Chinese Patent Application No. 201310470509.8, 16 pages.
Chinese Notice of Allowance dated Sep. 5, 2017 from Chinese Patent Application No. 201310470509.8, 5 pages.

* cited by examiner

WASHING MACHINE HAVING A PLURALITY OF CONCENTRICALLY FORMED RECESSED PORTIONS ON THE TUB

CROSS-REFERENCE TO RELATED APPLICATIONS

This application claims the benefit of Korean Patent Applications No. 10-2012-0112682, filed on Oct. 10, 2012 and No. 10-2013-0108121, filed on Sep. 9, 2013 in the Korean Intellectual Property Office, the disclosures of which are incorporated herein by reference.

BACKGROUND

1. Field

Embodiments of the present disclosure relate to a washing machine including a washing tub to allow enhancement in washing efficiency.

2. Description of the Related Art

In general, washing machines are classified into a pulsator type and a drum type according to washing methods, and all of the pulsator type and drum type washing machines include a water reservoir and a washing tub.

However, in the pulsator type washing machine, a rotational shaft of the washing tub in which washing is performed is arranged so as to be perpendicular to the ground. A pulsator to generate a wash water stream is installed at a lower portion of the washing tub. In the pulsator type washing machine, the pulsator agitates laundry, which is inserted into the washing tub, together with wash water while the washing tub and the pulsator are rotated by a motor in a state in which the laundry and detergent are inserted into the washing tub, thereby enabling elimination of laundry stains.

In the drum type washing machine, washing is performed by tumbling. The washing tub is provided with a lifter to lift the laundry.

In the pulsator type and drum type washing machines, the washing tub is provided, at a circumferential portion thereof, with a drain hole, which allows water in the water reservoir to be introduced into the washing tub and water in the washing tub to be discharged from the washing tub during drainage and dehydration.

The drain hole is conventionally arranged at an inner surface of the planar washing tub. In this case, since friction between the inner surface of the planar washing tub and laundry is not significant, there is a limit to enhancement in washing efficiency by friction.

SUMMARY

Therefore, it is an aspect of the present disclosure to provide a washing machine which enhances washing efficiency of laundry and simultaneously has an improved structure of a washing tub into or from which wash water may be efficiently introduced or discharged.

Additional aspects of the disclosure will be set forth in part in the description which follows and, in part, will be apparent from the description, or may be learned by practice of the disclosure.

In accordance with one aspect of the present disclosure, a washing machine includes a main body, a washing tub which is rotatably provided inside the main body and accommodates laundry, and at least one pattern formed on an inner surface of the washing tub, wherein the pattern includes a first protrusion portion which is provided at a central portion of the pattern and protrudes toward one side of the washing tub, at least one second protrusion portion which is expanded to surround the first protrusion portion and protrudes toward one side of the washing tub, a recessed portion which is provided between the first and second protrusion portions and is recessed into the other side of the washing tub, and at least one drain hole disposed to share at least a portion of the recessed portion.

The first and second protrusion portions may have a concentric shape.

The protrusion portions may protrude in an asymmetric shape.

The protrusion portions may protrude to be inclined in an edge direction of the washing tub.

The plural drain holes may be arranged on the recessed portion which is recessed outward of the washing tub.

The recessed portion may be provided in a planar form.

The recessed portion may be provided in a curved surface form.

The plural protrusion portions may be provided in a circular shape.

The plural protrusion portions may be provided in a polygonal shape.

The washing machine may further include a lifter which protrudes from the inner surface of the washing tub such that the laundry is smoothly tumbled, and the lifter may further include an inflection portion in which a cross-sectional area at a central portion of the lifter is smaller than that at a distal portion thereof.

In accordance with another aspect of the present disclosure, a washing machine includes a main body, a washing tub which is rotatably provided inside the main body and accommodates laundry, a drive unit to rotate the washing tub, protrusion portions protruding inward of the washing tub, recessed portions configured to be recessed between the respective protrusion portions, and at least one pattern in which the protrusion portions and the recessed portions are alternately arranged and the protrusion portions and the recessed portions are arranged to have a concentric structure.

The washing tub may include a plurality of drain holes through which water is discharged, and the drain holes may be disposed on the recessed portions so as to be spaced apart from each other.

A distance between the protrusion portions may be increasingly narrowed as being away from a central portion of the concentric structure.

A distance between the drain holes disposed at each one protrusion portion may be increasingly widened as being away from a central portion of the concentric structure.

A distance between the protrusion portions may be increasingly widened as being away from a central portion of the concentric structure.

A distance between the drain holes disposed at each one protrusion portion may be increasingly narrowed as being away from a central portion of the concentric structure.

Distances between the respective protrusion portions may be equal to each other.

Distances between the respective drain holes disposed at one protrusion portion may be equal to each other.

The washing machine may further include a plurality of coupled portions which are coupled with components located inside the washing tub and are disposed between the respective patterns.

Each of the coupled portions may be coupled with a lifter which protrudes from the inner surface of the washing tub such that the laundry is smoothly tumbled.

In accordance with a further aspect of the present disclosure, a washing machine includes a main body, a washing tub which is rotatably provided inside the main body and accommodates laundry, a plurality of lifters protruding from an inner surface of the washing tub such that the laundry is smoothly tumbled, and a pattern which is provided in the washing tub and formed between the plural lifters, wherein the pattern includes a first protrusion portion formed in a closed curve, at least one second protrusion portion formed in another closed curve surrounding the first protrusion portion, and at least one drain hole disposed between the first and second protrusion portions.

Each of the lifters may include an inflection portion in which at least a portion of the lifter has a narrow width such that the lifter corresponds to shapes of the protrusion portions.

The pattern may further include a third protrusion portion at least a portion of which surrounds the second protrusion portion and is opened by the lifters.

The pattern may further include a third protrusion portion at least a portion of which surrounds the second protrusion portion and is opened by both ends of the washing tub.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
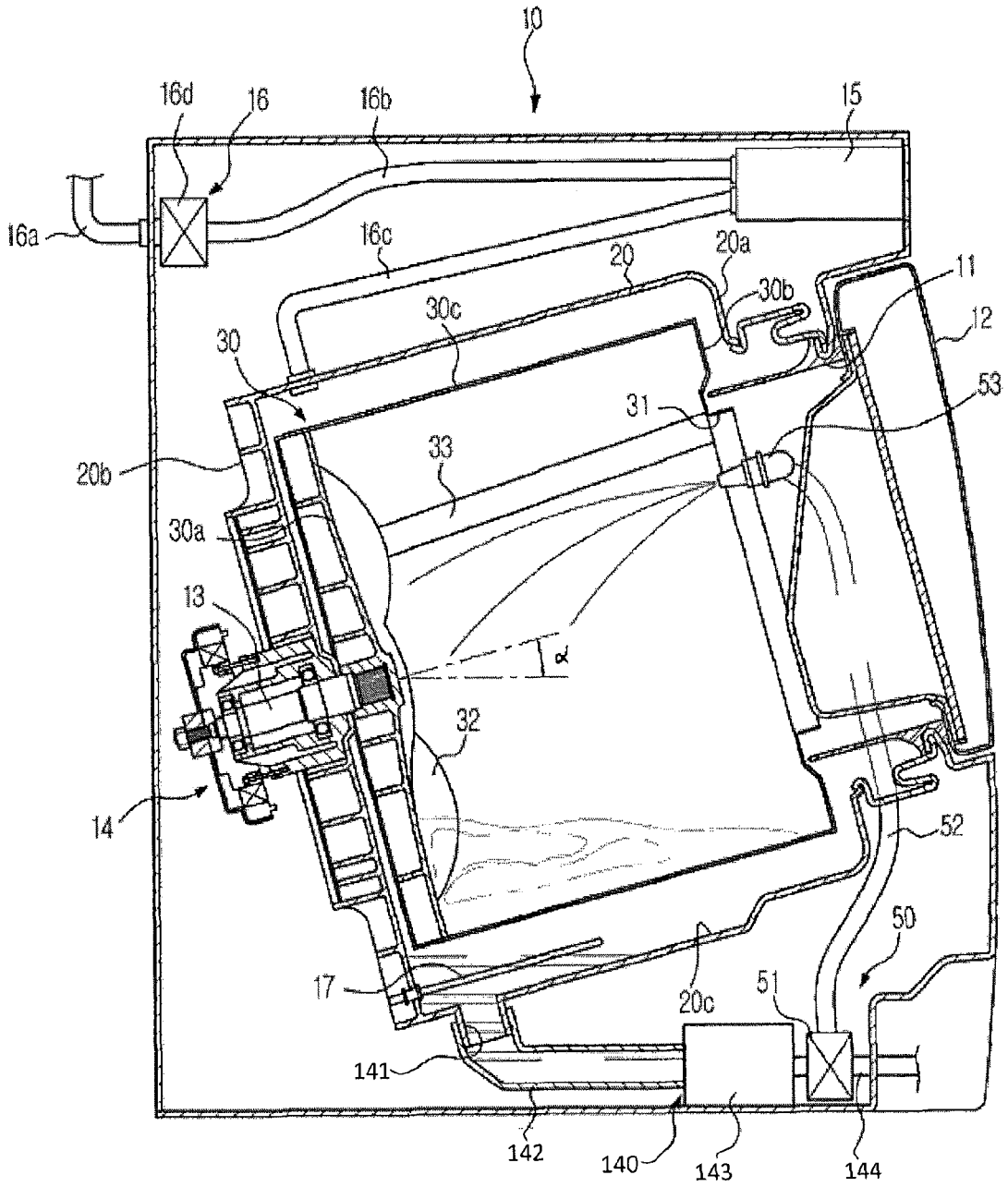
FIG. 1 is a cross-sectional view illustrating a washing machine according to an embodiment of the present disclosure.

Reference will now be made in detail to the embodiments of the present disclosure, examples of which are illustrated in the accompanying drawings, wherein like reference numerals refer to like elements throughout. Hereinafter, although a drum washing machine will be described by way of example, the present disclosure is not limited thereto. For example, the configuration of a washing tub according to the present disclosure is also applicable to a fully automatic washing machine.

Figure 2:
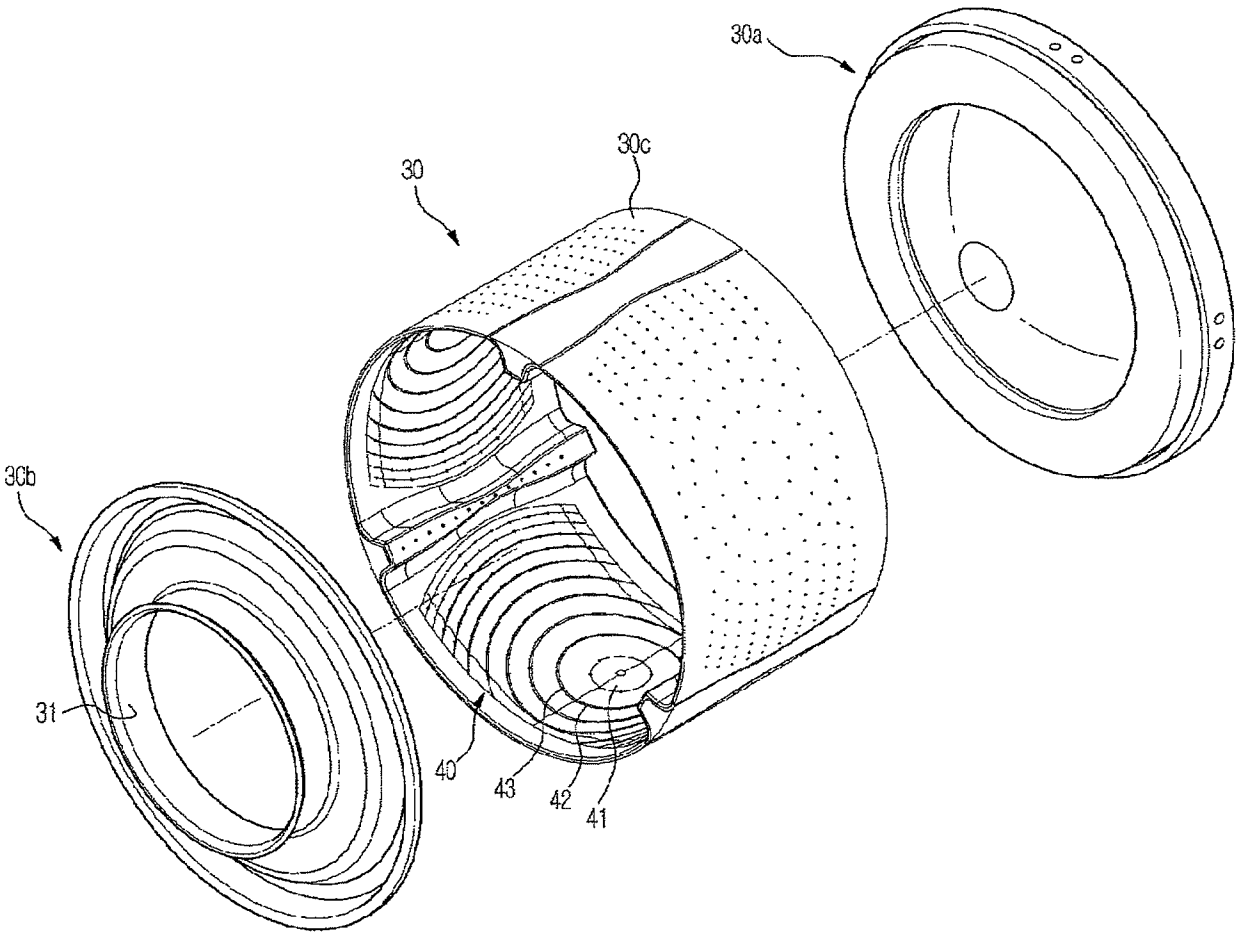
FIG. 2 is an exploded perspective view illustrating a washing tub applied to the washing machine according to the embodiment of the present disclosure.

FIG. 1 is a cross-sectional view illustrating a washing machine according to an embodiment of the present disclosure. FIG. 2 is an exploded perspective view illustrating a washing tub applied to the washing machine according to the embodiment of the present disclosure.

As shown in FIGS. 1 and 2, a washing machine 1 includes a main body 10 having at a front surface thereof an insertion port 11 through which laundry is inserted, a water reservoir 20 installed within the main body 10 to store wash water, and a washing tub 30 rotatably provided inside the water reservoir 20 to accommodate the laundry. In addition, the washing machine 1 includes a door 12 to open and close the insertion port 11 of the main body 10.

The water reservoir 20 is installed to be inclined with respect to an installation surface of the washing machine 1 by a predetermined angle $\alpha$ such that a front surface portion 20*a* formed with an inlet is located above a rear surface portion 20*b*, and the washing tub 30 is installed to be inclined in a similar form to the water reservoir 20, but the present disclosure is not limited thereto. For example, the water reservoir and the washing tub may also be installed so as not to be inclined.

The washing tub 30 is coupled, at a rear surface portion 30*a* thereof, to a rotational shaft 13 passing through the rear surface portion 20*b* of the water reservoir 20 so as to be rotatably supported by the rotational shaft 13. In addition, a drive motor 14 to rotate the rotational shaft 13 is installed outside the rear surface portion 20*b* of the water reservoir 20. The drive motor 14 rotates the rotational shaft 13 so that the washing tub 30 within the water reservoir 20 may be rotated by the rotational shaft 13. The drive motor 14 rotates the washing tub 30 at low speed during washing, and rotates the washing tub 30 at high speed in one direction during dehydration.

The water reservoir 20 is provided, at an upper portion thereof, with a detergent supply unit 15 to supply detergent into the water reservoir 20 and a water supply unit 16 to supply wash water into the water reservoir 20. The detergent supply unit 15 is installed at a front surface side of the main body 10. The water supply unit 16 includes a first water supply tube 16*b* which connects an external water supply tube 16*a* to the detergent supply unit 15, a second water supply tube 16*c* which connects the detergent supply unit 15 to the water reservoir 20, and a water supply control valve 16*d* which is installed at the first water supply tube 16*b* to control supply of water. This enables water to be supplied via the detergent supply unit 15 to the water reservoir 20 together with detergent.

The water reservoir 20 is provided, at an inside lower portion thereof, with a heater 17 to heat wash water. The water reservoir 20 is provided, at a lower portion thereof, with a heater accommodation portion 20*c* which protrudes downward in order to install the heater 17. The heater accommodation portion 20*c* serves to accommodate the heater 17 therein and simultaneously collect wash water therein.

The water reservoir 20 is provided, at an outside lower portion thereof, with a drain unit 140 to discharge wash water in the water reservoir 20, and a wash water circulation unit 50 to supply wash water in the water reservoir 20 into the washing tub 30. The drain unit 140 includes a first drain tube 142 connected to a drain port 141 at the lower portion of the water reservoir 20, a drain pump 143 installed at the first drain tube 142, and a second drain tube 144 connected to an outlet side of the drain pump 143.

The wash water circulation unit 50 includes a passage switching valve 51 installed at the second drain tube 144 at the outlet side of the drain pump 143, a wash water circulation tube 52 extending from the passage switching valve 51 toward an inlet 31 of the washing tub 30, and an injection nozzle 53 installed at an outlet of the wash water circulation tube 52. The passage switching valve 51 may discharge wash water from the outlet of the drain pump 143 to the outside or switch the wash water so as to flow toward the wash water circulation tube 52. The passage switching valve 51 may be configured of a typical electric three-way valve. This enables wash water in the water reservoir 20 to be injected via the first drain tube 42 and the wash water circulation tube 52 into the washing tub 30 when the drain pump 143 operates in an operated state of the passage switching valve 51 such that the wash water flows toward the wash water circulation tube 52. When the drain pump 143 operates in an operated state of the passage switching valve 51 such that wash water flows toward the second drain tube 144 to be discharged outward, the wash water in the water reservoir 20 is discharged.

The washing tub 30 includes a rear surface portion 30*a* coupled to the rotational shaft 13, a front surface portion 30*b* formed with the inlet 31, a cylindrical circumferential portion 30*c* both ends of which are respectively coupled to the front surface portion 30*b* and the rear surface portion 30*a*. The circumferential portion 30*c* of the washing tub 30 is provided, at an inner surface thereof, with a plurality of lifters 33 which serve to tumble laundry when the washing tub 30 rotates, and the rear surface portion 30*a* of the washing tub 30 is formed, at an inner surface thereof, with a plurality of agitating protrusions 32 which serve to enhance washing efficiency. In addition, at least one pattern 40 including a plurality of protrusion portions 41 and a plurality of drain holes 43 is arranged on an inner surface of the washing tub 30, as will be described later.

Figure 3:
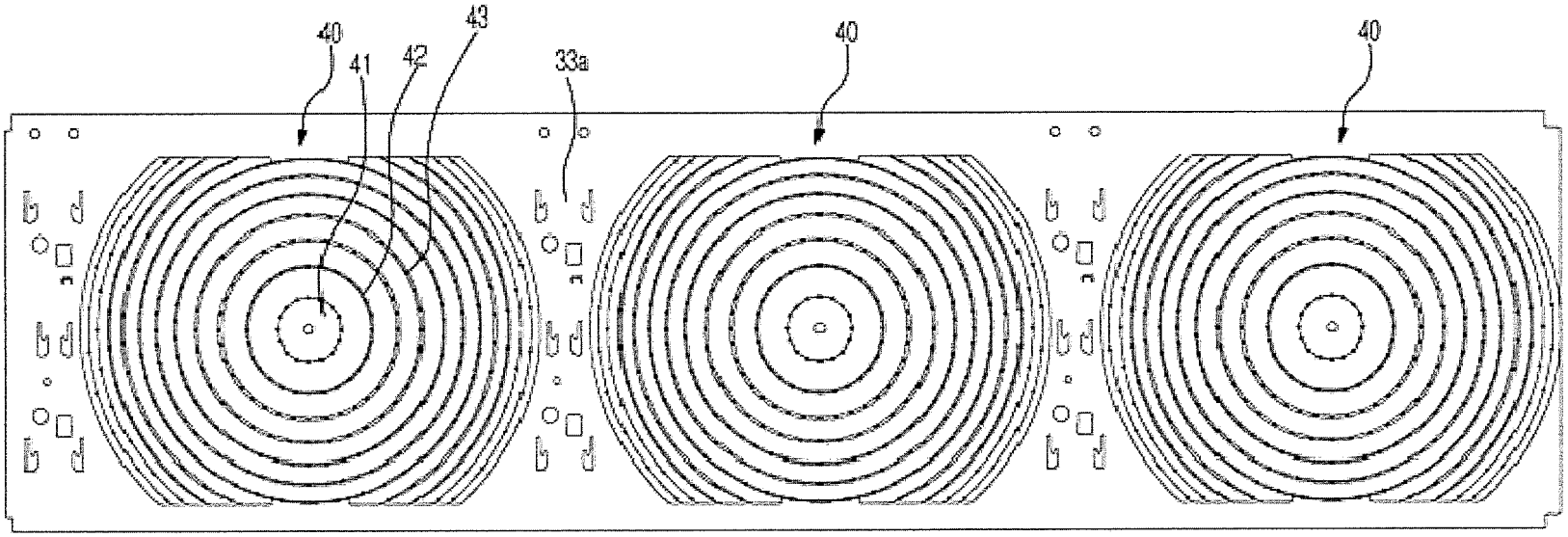
FIG. 3 is a view illustrating a state in which the washing tub according to the embodiment of the present disclosure is unfolded.
Figure 4:
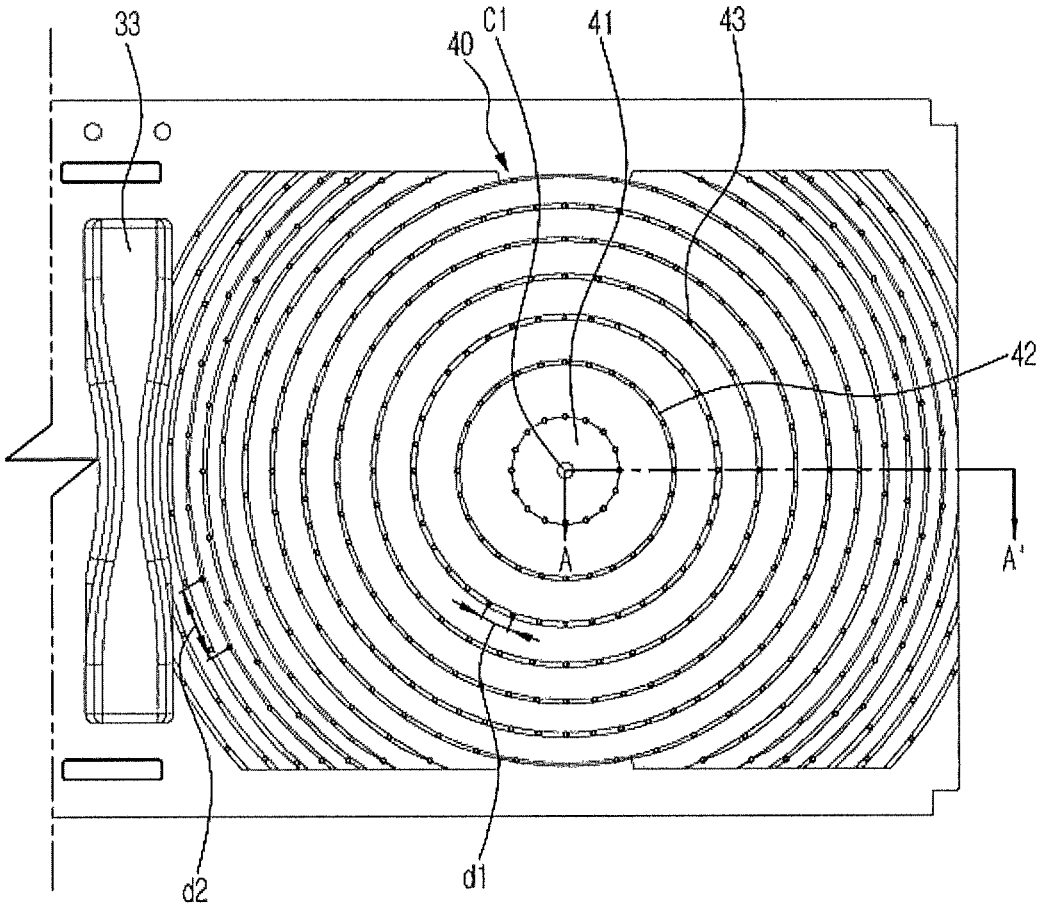
FIG. 4 is an enlarged view illustrating a pattern placed in the washing tub of the washing machine according to the embodiment of the present disclosure.
Figure 5:
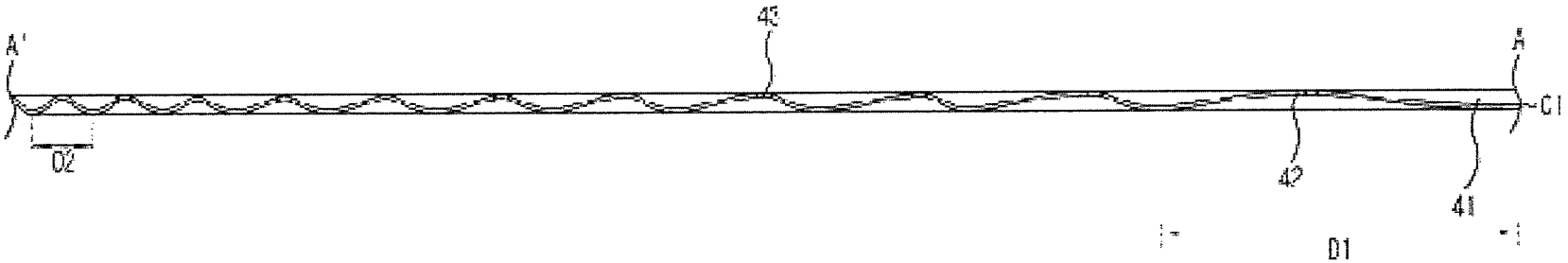
FIG. 5 is a cross-sectional view taken along line A-A in FIG. 4.

FIG. 3 is a view illustrating a state in which the washing tub according to the embodiment of the present disclosure is unfolded. FIG. 4 is an enlarged view illustrating the pattern placed in the washing tub of the washing machine according to the embodiment of the present disclosure. FIG. 5 is a cross-sectional view taken along line A-A' in FIG. 4. A lower side in FIG. 5 refers to a central portion of the pattern on the washing tub, and an upper side thereof refers to an edge portion of the pattern on the washing tub.

As shown in FIGS. 3 to 5, at least one pattern 40 may be provided inside the washing tub 30. A variety of components may be provided inside the washing tub 30. Examples of the components may include a lifter and a guide filter. The lifter 33 is mainly used for a drum washing machine to smoothly tumble laundry, and the guide filter is mainly used for a fully automatic washing machine. A portion of the washing tub 30 to which the components are coupled is defined as a coupled portion 33*a*. The respective patterns 40 placed inside the washing tub 30 may be located around the coupled portion 33*a* as a boundary therebetween. In other words, two patterns may be provided if one coupled portion is present, and three patterns may be provided if two coupled portions are present.

The pattern 40 includes the protrusion portions 41 protruding toward one side of the washing tub 30 and the plural drain holes 43 arranged around the protrusion portions 41. Although the protrusion portions 41 are illustrated as protruding inward of the washing tub 30 in the drawing, the present disclosure is not limited thereto. The protrusion portion provided at the center portion among the plural protrusion portions 41 is referred to as a first protrusion portion, and the protrusion portions expanded to surround the first protrusion portion are referred to as second protrusion portions. That is, the first protrusion portion may be formed in a closed curve, and each of the second protrusion portions may be formed in another closed curve surrounding the first protrusion portion. A recessed portion 42 may be located between each of the protrusion portions 41. At least one drain hole 43 may be disposed to share at least a portion of the recessed portion 42. The drain hole 43 may also be disposed only at the recessed portion 42, or may also be disposed across the recessed portion 42 and the associated protrusion portion 41 by sharing at least a portion of the recessed portion 42. The plural protrusion portions 41 may have a concentric structure in which the same shapes are repeated about a center C1. In accordance with the embodiment of the present disclosure, the plural protrusion portions 41 may be provided in the concentric structure.

The protrusion portion 41 may be provided in at least one geometrical figure. That is, although the protrusion portion 41 is illustrated to be formed as a circle in the drawing, the present disclosure is not limited thereto. The protrusion portion 41 may also be formed in a plurality of geometrical figures. For example, circular and rectangular protrusion portions may also be alternately arranged.

The recessed portion 42 configured to be recessed into the inner surface of the washing tub 30 may be disposed between one protrusion portion 41 and another protrusion portion 41. In other words, the recessed portion 42 is disposed between the protrusion portions 41, and the protrusion portion 41 and the recessed portion 42 are alternately arranged to thereby form one pattern 40. In accordance with the embodiment of the present disclosure, the protrusion portion 41 is disposed at the center and the recessed portion 42 is subsequently disposed. That is, the protrusion portion 41 and the recessed portion 42 may be disposed from the center of the washing tub 30 in this order, but the present disclosure is not limited thereto.

The drain holes 43 may be arranged on the recessed portion 42 so as to be spaced apart from each other. That is, the drain holes 43 may be provided at the outermost portion of the washing tub 30 so that dehydration is efficiently performed using centrifugal force. When the recessed portion 42 is recessed outward of the washing tub 30, the drain holes 43 are disposed on the recessed portion 42 and may be disposed at the outermost portion of the washing tub 30.

Referring to the drawing, distances D1 and D2 between the respective protrusion portions 41 may be configured to be increasingly narrowed in the outward direction of the washing tub 30. That is, the distance D1 may be larger than the distance D2. However, the present disclosure is not limited thereto. For example, the distances may be configured to be equal to each other, or to be increasingly widened in the outward direction of the washing tub 30.

In the drain holes 43 disposed on the recessed portions 42 around the protrusion portions 41, the drain holes 43 may be spaced at regular intervals with respect to one recessed portion 42. When the distances between the respective protrusion portions 41 are configured to be increasingly narrowed in the outward direction of the washing tub, distances between the recessed portions 42 located between the respective protrusion portions 41 are also narrowed. In this case, a distance d2 between the drain holes 43 on the recessed portion 42 located at the outside may be configured to be larger than a distance d1 between the drain holes 43 on the recessed portion 42 located at the center C1, and vice versa. This will be described later.

The above configuration enables the number of the drain holes 43 to be adjusted according to the distances between the respective recessed portions 42. Therefore, the total number of the drain holes 43 placed in the washing tub 30 may be adjusted by adjusting the distances between the respective drain holes 43 even when the distances between the respective recessed portions 42 are different from each other.

Each protrusion portion 41 is provided to protrude from the inner surface of the washing tub 30. Although the protrusion portion 41 protrudes in an asymmetric shape about a central axis thereof in the drawing, the present disclosure is not limited thereto. For example, the protrusion portion 41 may protrude in a symmetric shape. The protrusion portion 41 may protrude to be inclined toward one side with respect to the surface of the washing tub 30. In accordance with the embodiment of the present disclosure shown in the drawing, the protrusion portion 41 may protrude to be inclined in an outer edge direction of the washing tub 30. That is, the most protrusion point 44 of the protrusion portion 41 may be provided to be inclined in the outward direction. However, the present disclosure is not limited thereto, and the protrusion portion 41 may also protrude to be inclined in a center direction of the washing tub 30. Since the protrusion portions 41 and the recessed portions 42 are alternately arranged and connected, the washing tub 30 may have increased stiffness.

In addition, the plural protrusion portions 41 are arranged so as to enable wash water inside the washing tub 30 to flow.

In addition, the recessed portion 42 may be curved, but the present disclosure is not limited thereto. Therefore, since the protrusion portion 41 and the recessed portion 42 have a continuous curved surface, damage to laundry may be prevented.

The lifter 33 may be located between one pattern 40 and another pattern 40. The lifter 33 may be provided so as to correspond to a shape of the pattern 40. Accordingly, the lifter 33 may function without countering the effect of the pattern 40 caused due to the position of the lifter 33. As an example, when the protrusion portion 41 is provided in a circular form as shown in the drawing, the lifter 33 may include an inflection portion 34 in which a cross-sectional area at a central portion of the lifter 33 is smaller than that at a distal portion thereof such that the lifter 33 corresponds to the circular form of the protrusion portion.

The protrusion portion 41 may further include third protrusion portions which are opened at a portion thereof by the lifter 33 and surround the second protrusion portions. Each of the third protrusion portions is not formed in a closed curve by the lifter 33. The third protrusion portion may also be opened by both ends of the washing tub 30 as well as being opened by the lifter 33. In this case, the recessed portion 42 may be disposed between the third protrusion portions, and the drain holes 43 may be disposed on at least a portion of the recessed portion 42.

Figure 6:
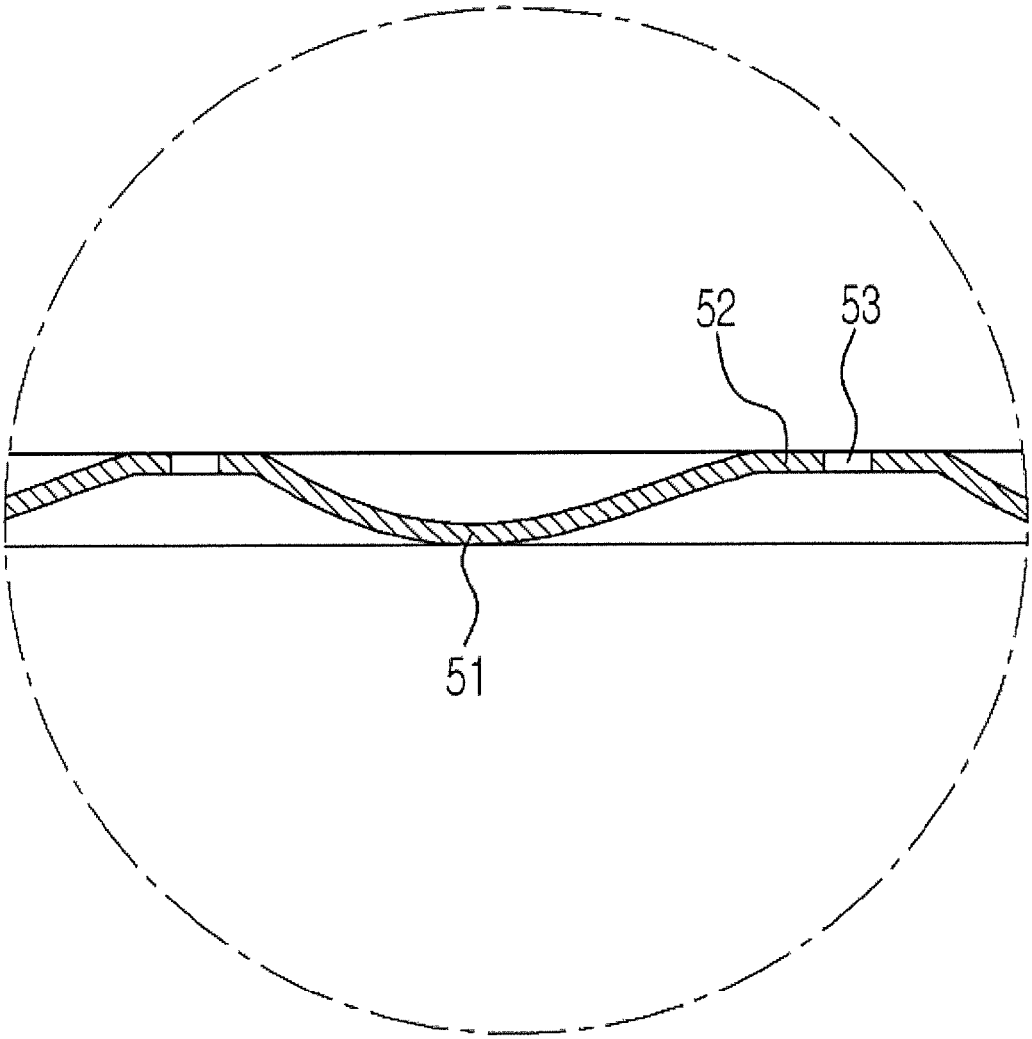
FIG. 6 is a cross-sectional view illustrating a state in which a washing tub according to another embodiment of the present disclosure is unfolded.
Figure 7:
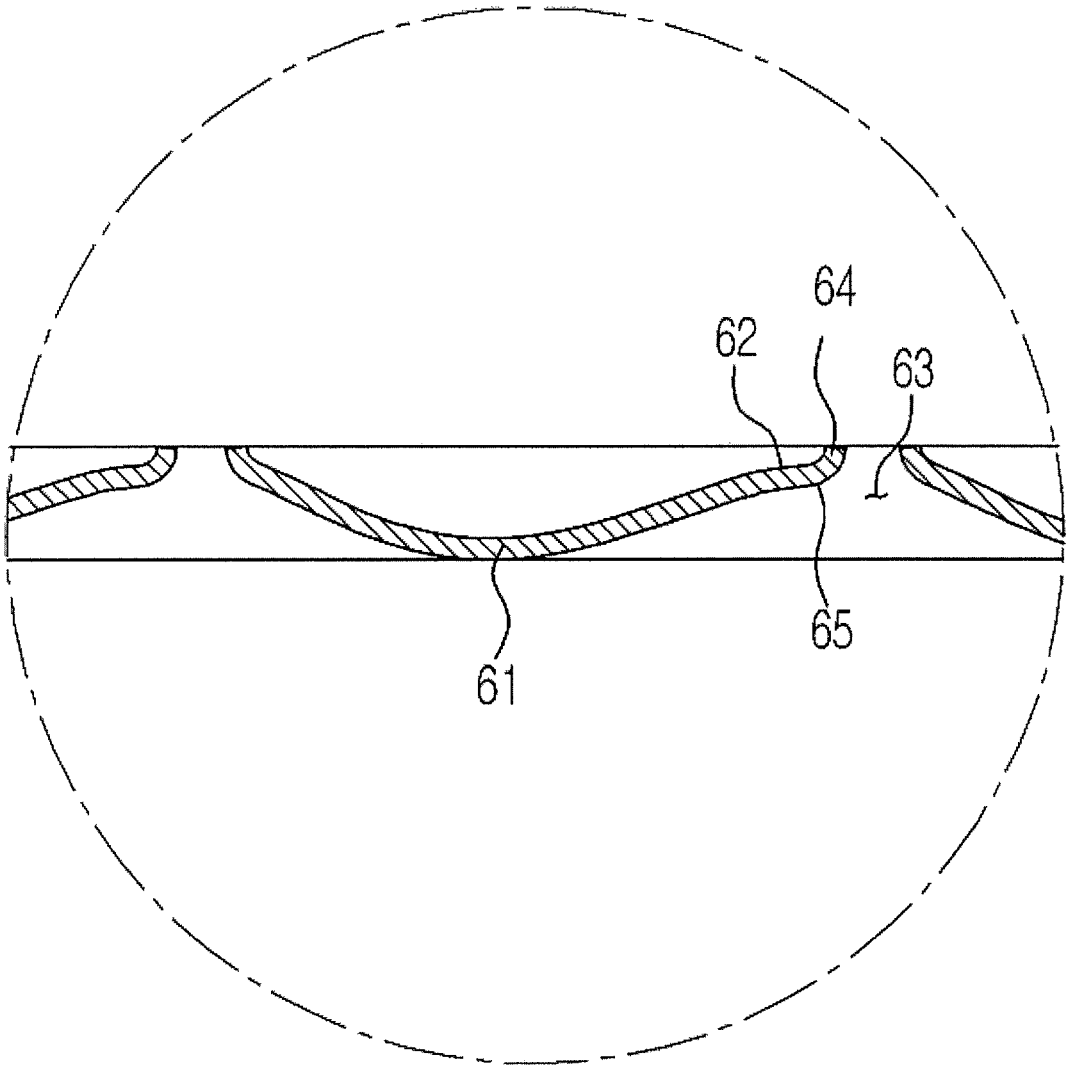
FIG. 7 is a cross-sectional view illustrating a state in which a washing tub according to another embodiment of the present disclosure is unfolded.

FIG. 6 is a cross-sectional view illustrating a state in which a washing tub according to another embodiment of the present disclosure is unfolded. FIG. 7 is a cross-sectional view illustrating a state in which a washing tub according to another embodiment of the present disclosure is unfolded. A lower side in each of FIGS. 6 and 7 refers to an inner portion of the washing tub, and an upper side thereof refers to an outer portion of the washing tub.

As shown in FIG. 6, a recessed portion 51 may be provided in a planar form. This has an advantage capable of arranging drain holes 53 and efficiently performing an addition process during manufacture. In particular, this may be used for a case of additionally performing a burring process as shown in FIG. 7.

In the embodiment of the present disclosure shown in FIG. 7, a drain hole 63 may act as a burring hole. The burring hole undergoes a burring process. When the burring process is performed, flange portions 64 and 65 protrude outward of the washing tub 30 around the drain hole 63. The flange portions 64 and 65 include a first flange portion 64 located on an outer surface of the washing tub 30 and a second flange portion 65 extending from the first flange portion 64 to be formed on an inner surface of the washing tub 30. The first and second flange portions 64 and 65 may be formed using the burring process.

When the burring process is not performed, laundry may be torn by a cut surface of the drain hole. However, when the burring process is performed, the cut surface is formed outside the washing tub 30 by the flange portions 64 and 65 formed during the burring process, thereby enabling prevention of damage to laundry.

Figure 8:
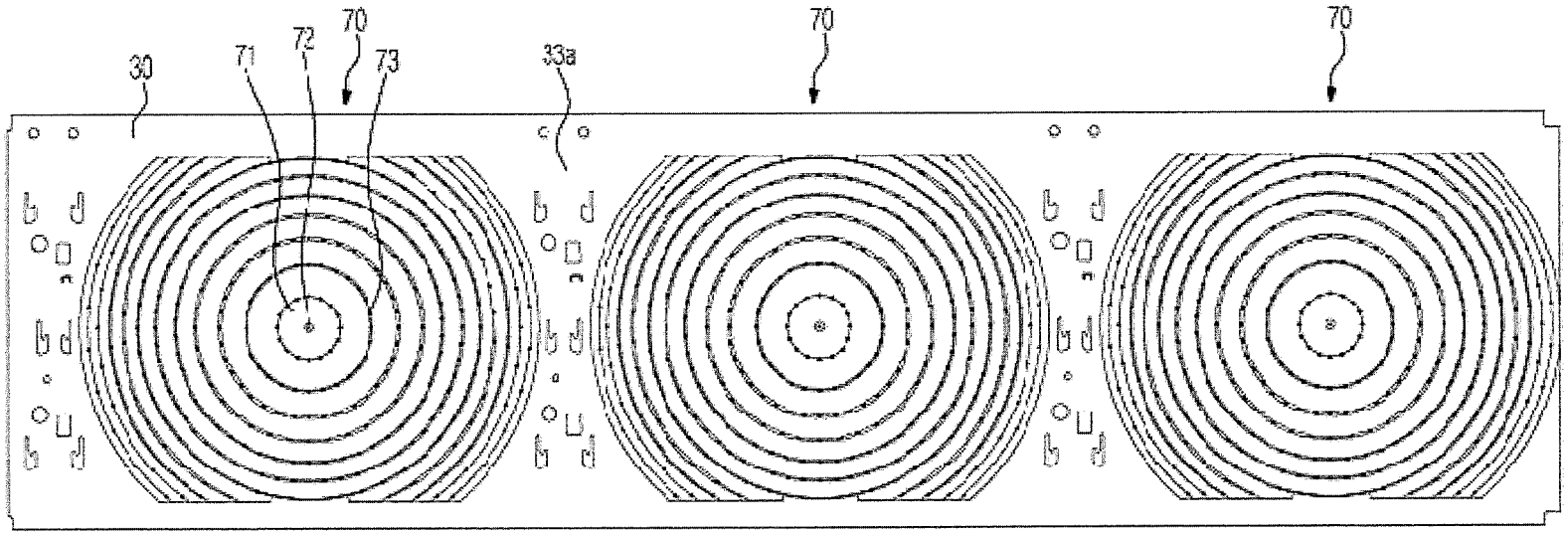
FIG. 8 is a view illustrating a state in which a washing tub according to yet another embodiment of the present disclosure is unfolded.
Figure 9:
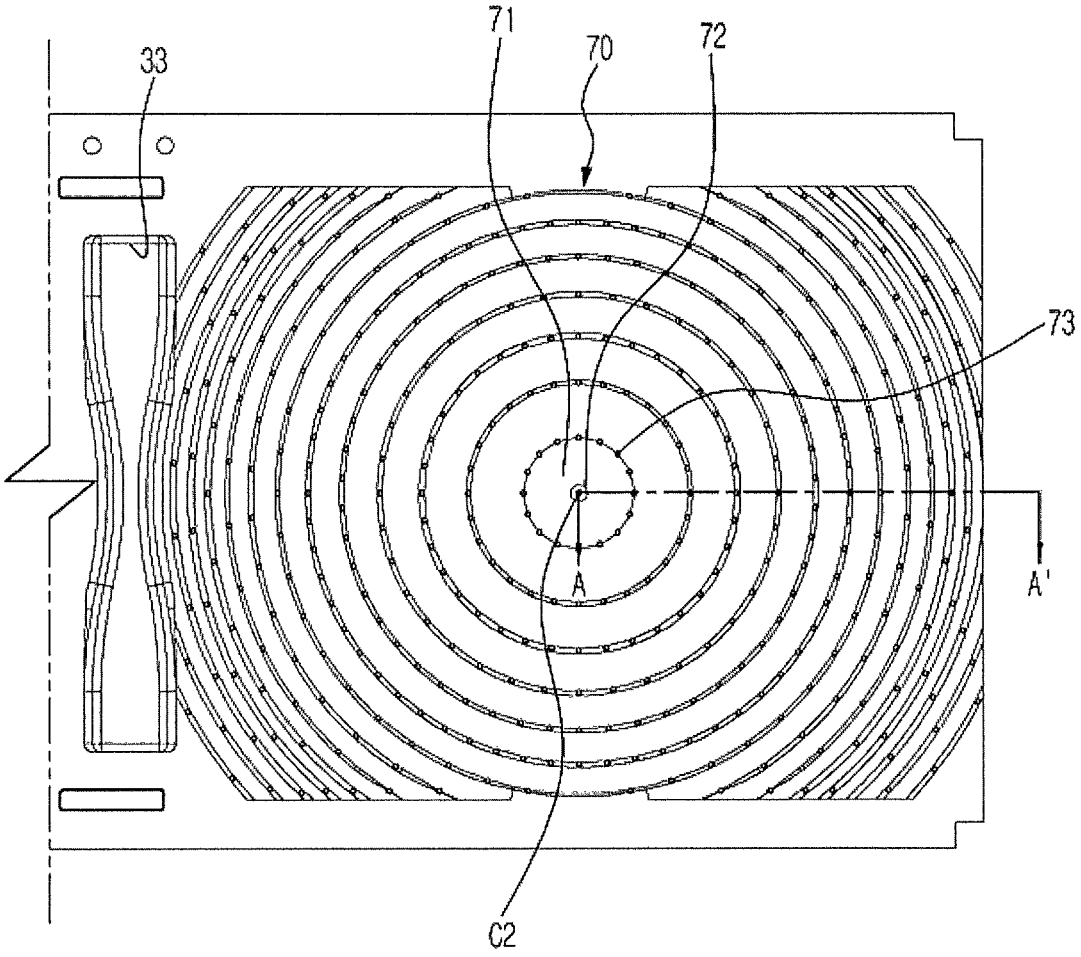
FIG. 9 is an enlarged view illustrating a pattern placed in the washing tub of the washing machine according to still embodiment of the present disclosure.
Figure 10:
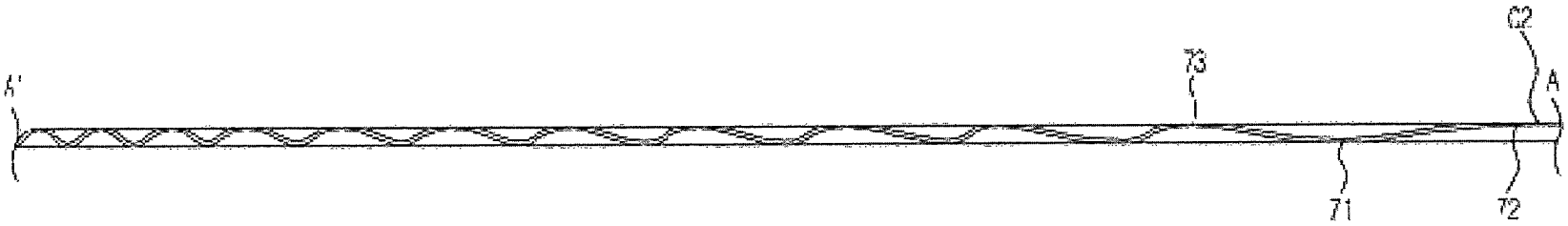
FIG. 10 is a cross-sectional view taken along line A-A' in FIG. 9.

FIG. 8 is a view illustrating a state in which a washing tub according to yet another embodiment of the present disclosure is unfolded. FIG. 9 is an enlarged view illustrating a pattern placed in the washing tub of the washing machine according to still embodiment of the present disclosure. FIG. 10 is a cross-sectional view taken along line A-A' in FIG. 9. A lower side in FIG. 10 refers to an inner side of the washing tub, and an upper side thereof refers to an outer side of the washing tub.

In the embodiment of the present disclosure shown in FIGS. 8 to 10, a recessed portion 72 may be located at a center of the washing tub 30, and a drain hole 73 may be located on the recessed portion 72. That is, the recessed portion 72 and a protrusion portion 71 may be arranged from the center of the washing tub 30 in this order. In other words, unlike the embodiment of the present disclosure shown in FIGS. 2 to 4, the recessed portion 72 is located at a center of a pattern 70 in the embodiment of the present disclosure shown in FIGS. 8 to 10.

Figure 11:
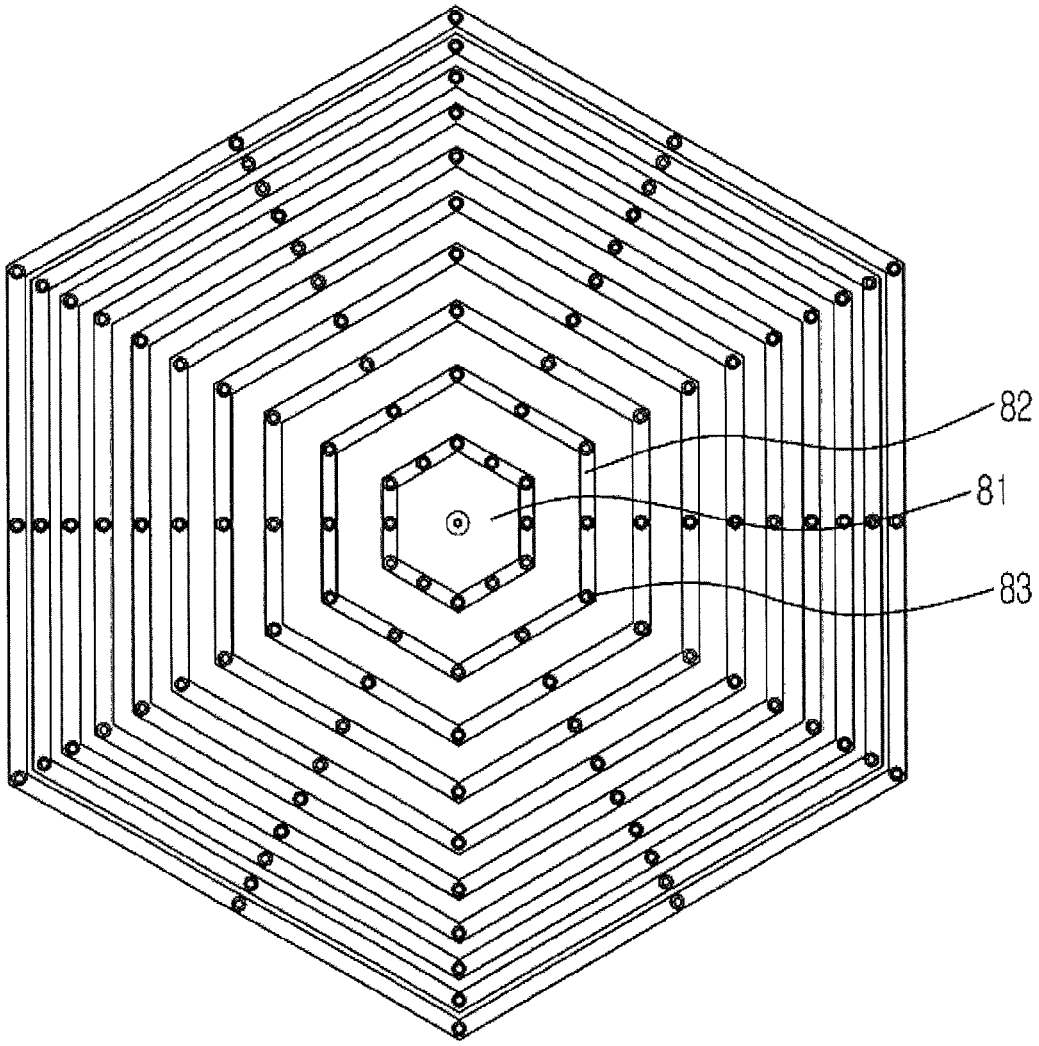
FIG. 11 is a view illustrating a pattern of a washing tub according to yet another embodiment of the present disclosure.

FIG. 11 is a view illustrating a pattern of a washing tub according to yet another embodiment of the present disclosure.

As shown in FIG. 11, each protrusion portion 81 may be provided in a polygonal shape. Although the protrusion portion 81 is illustrated as being hexagonal in the drawings, the present disclosure is not limited thereto. A hexagonal recessed portion 82 is provided between one protrusion 81 and another protrusion portion 81. However, as already described above, the recessed portion 82 and the protrusion portion 81 need not be provided as the same shape. Although drain holes 83 are located on the recessed portion 82 and are arranged at apexes and sides of the hexagon, the present disclosure is not limited thereto. For example, the drain holes may also be located on at least one of the apexes and sides of the polygon.

Figure 12:
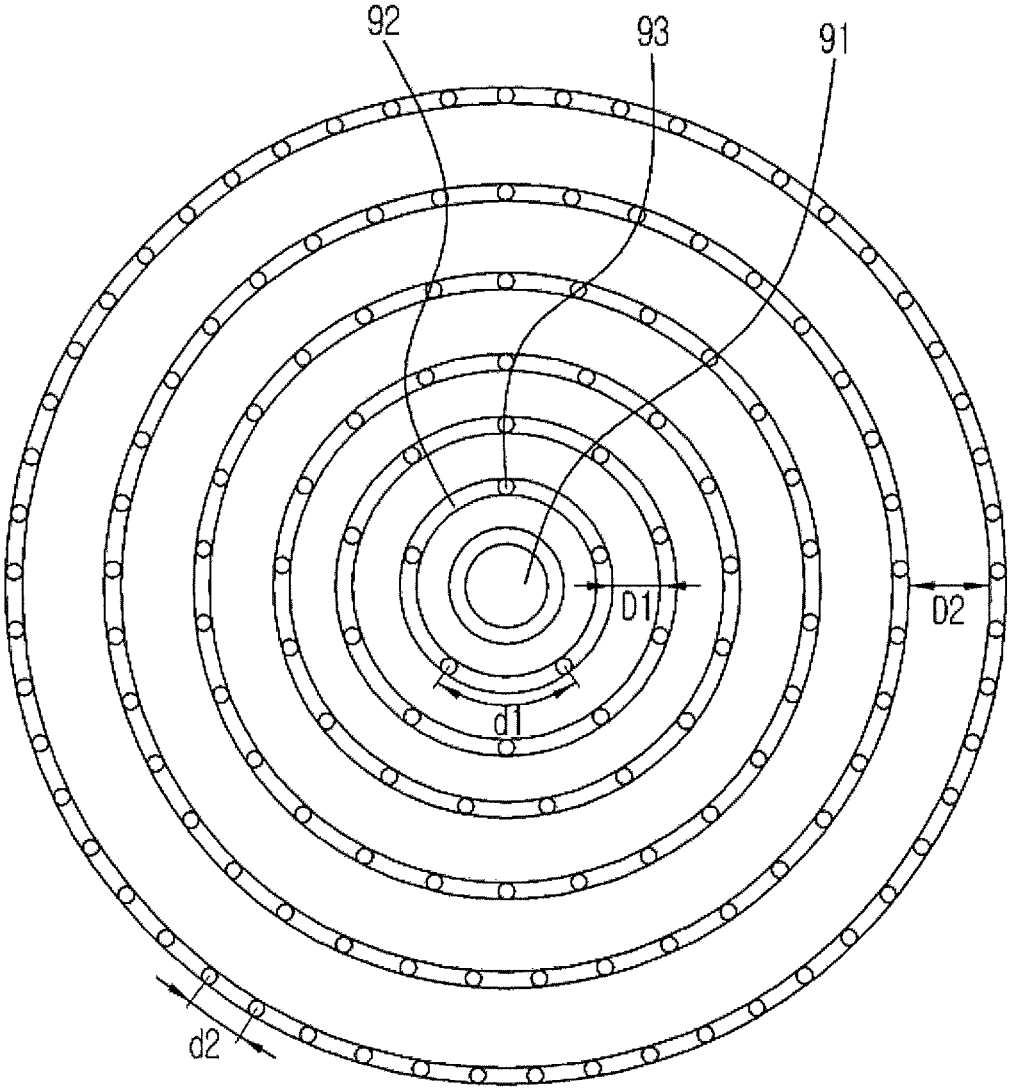
FIG. 12 is a view illustrating a pattern of a washing tub according to yet another embodiment of the present disclosure.

FIG. 12 is a view illustrating a pattern of a washing tub according to yet another embodiment of the present disclosure.

As shown in FIG. 12, when distances between respective protrusion portions 91 are configured to be increasingly widened in the outward direction of the washing tub, distances between recessed portions 92 located between the respective protrusion portions 91 are also widened. In this case, a distance d2 between drain holes 93 on the recessed portion 92 located at the outside may be configured to be smaller than a distance d1 between the drain holes 93 on the recessed portion 92 located at the inner side. This enables the drain holes 93 to be located substantially uniformly in the washing tub 30. Therefore, it may be possible to prevent wash water from being concentrated at a certain position.

Figure 13:
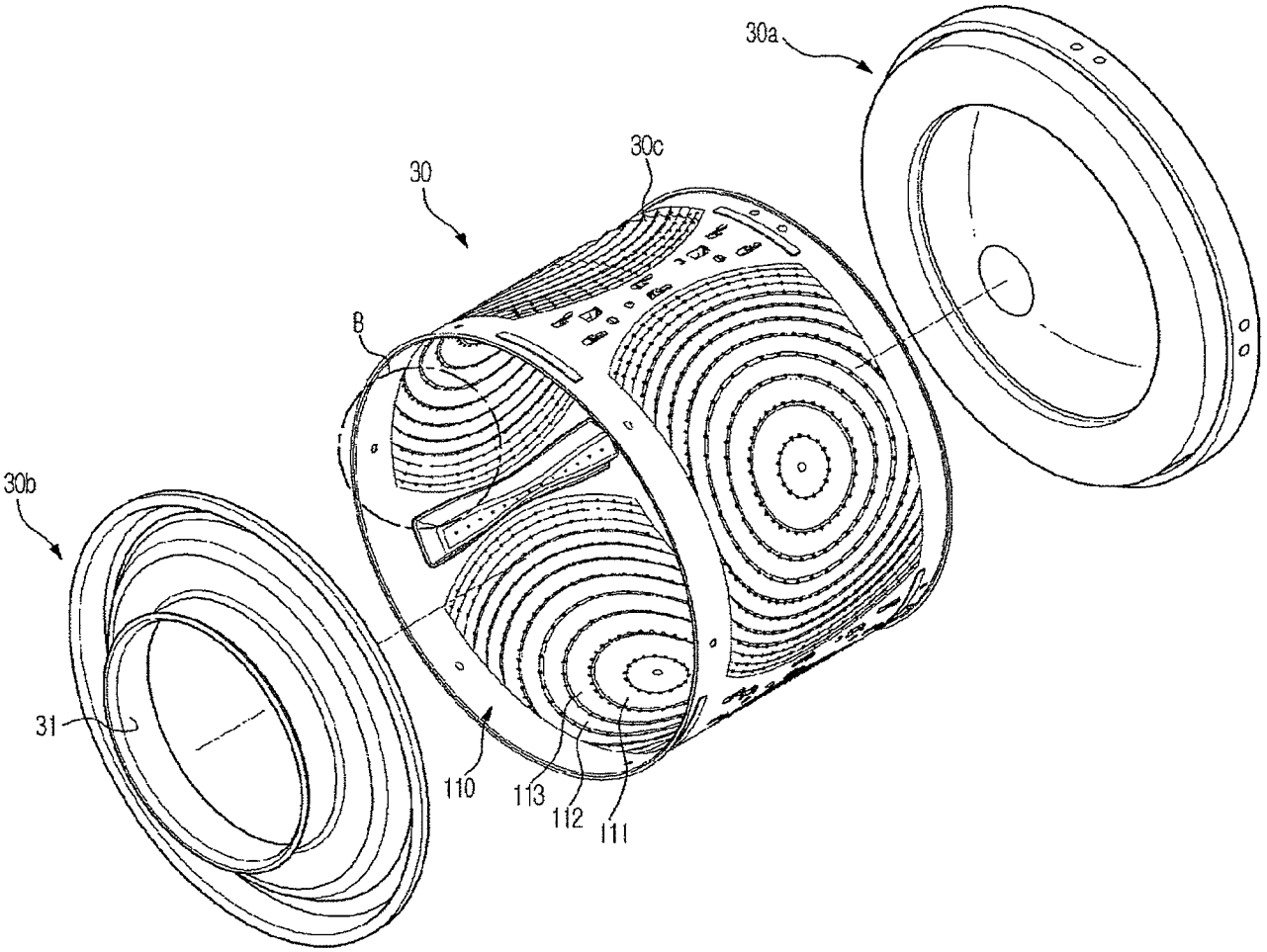
FIG. 13 is an exploded perspective view illustrating a washing tub applied to a washing machine according to a further embodiment of the present disclosure.
Figure 14:
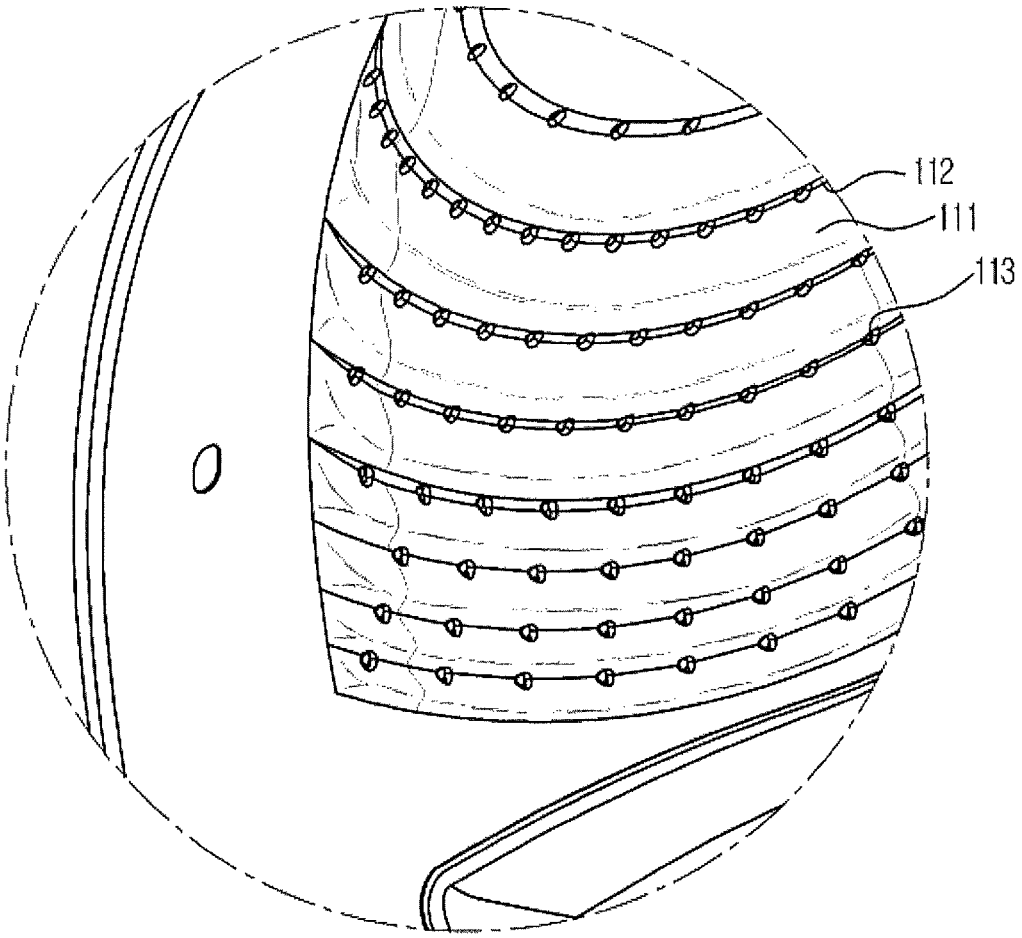
FIG. 14 is an enlarged view of portion "B" in FIG. 13.
Figure 15:
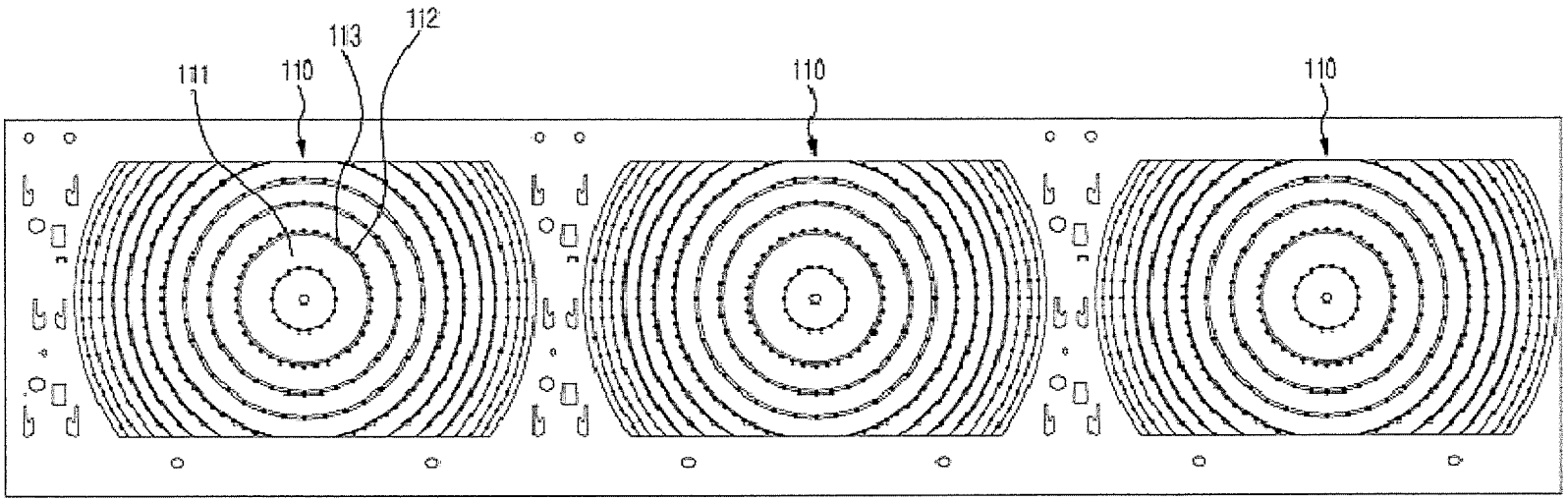
FIG. 15 is a view illustrating a state in which the washing tub according to the further embodiment of the present disclosure is unfolded.
Figure 16:
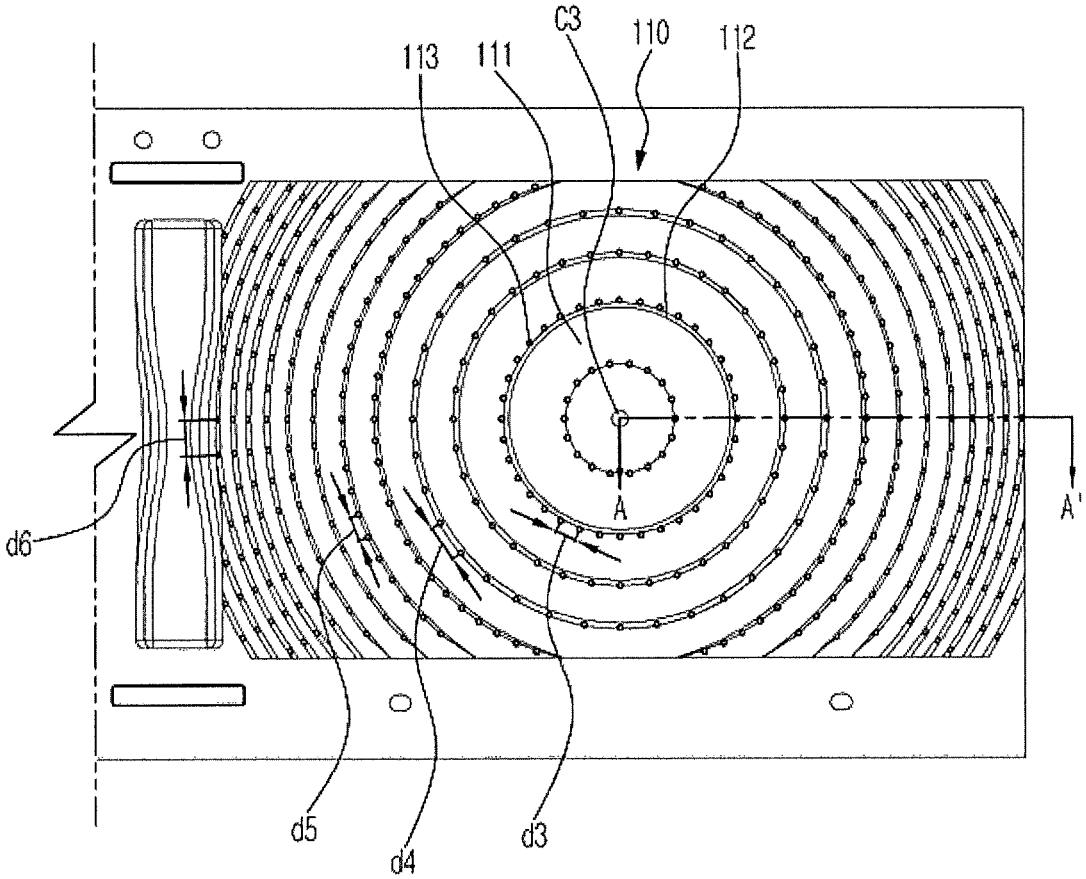
FIG. 16 is an enlarged view illustrating a pattern placed in the washing tub of the washing machine according to the further embodiment of the present disclosure.
Figure 17:
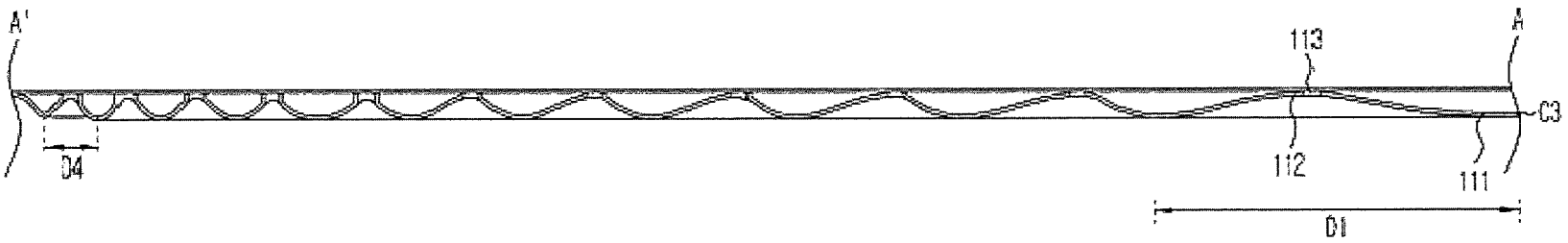
FIG. 17 is a cross-sectional view taken along line A-A' in FIG. 16.

FIG. 13 is an exploded perspective view illustrating a washing tub applied to a washing machine according to a further embodiment of the present disclosure. FIG. 14 is an enlarged view of portion "B" in FIG. 13. FIG. 15 is a view illustrating a state in which the washing tub according to the further embodiment of the present disclosure is unfolded. FIG. 16 is an enlarged view illustrating a pattern placed in the washing tub of the washing machine according to the further embodiment of the present disclosure. FIG. 17 is a cross-sectional view taken along line A-A' in FIG. 16. A lower side in FIG. 17 refers to a central portion of the pattern on the washing tub, and an upper side thereof refers to an edge portion of the pattern on the washing tub.

As shown in FIGS. 13 to 17, the pattern 110 of the washing tub 30 includes a plurality of protrusion portions 111. Like the previous embodiments, the embodiment of the present disclosure shown in FIGS. 13 to 17 includes a first protrusion portion and a second protrusion portion. In addition, drain holes 113 to discharge wash water may be arranged between the respective protrusion portions 111. Recessed portions 112 provided to be recessed outward of the washing tub 30 may be located between the respective protrusion portions 111. The drain holes 113 may be disposed near the recessed portions 112.

In accordance with the embodiment of the present disclosure, a distance D3 between the protrusion portions 111 located at a central portion C3 side may be larger than a distance D4 between the protrusion portions located at an outer side. In addition, a distance d3, d4, d5, or d6 between one drain hole 113 and another drain hole 113 located at one protrusion portion 111 may vary according to each of the protrusion portions 111. In accordance with the embodiment of the present disclosure, d3, d4, d5, and d6 which are the distances between the respective drain holes 113 may all differ from each other. That is, the distance between the drain holes 113 located at one protrusion portion 111 may also be configured to be increasingly widened and then narrowed again in the outward direction. In accordance with the embodiment of the present disclosure, the distance d4 may be larger than the distance d3, and the distance d5 may be smaller than the distance d4.

As is apparent from the above description, since a washing tub of a washing machine according to the embodiments of the present disclosure includes a pattern having a protrusion portion, it may be possible to generate friction force between laundry and the washing tub and increase washing efficiency due to flow of wash water generated by the pattern.

In addition, since the pattern has a concave-convex structure and performs action similar to a lifter, washing efficiency may be enhanced using tumbling generated by the pattern.

In addition, since a plurality of drain holes are arranged in a certain pattern in the washing tub, it may be possible to prevent a dehydration bottleneck phenomenon in which dehydration is concentrated at a particular drain hole and to increase a dehydration rate.

Furthermore, since the pattern is provided such that protrusion portions and recessed portions continue on the surface of the washing tub, it may be possible to enhance stiffness of the washing tub.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a main body;

a washing tub which is rotatably provided inside the main body and accommodates laundry; and at least two concentrically formed patterns formed on an inner surface of the washing tub, wherein each of the patterns comprises a first protrusion portion which is provided at a central portion of the pattern and protrudes toward one side of the washing tub;

a second protrusion portion which is expanded to surround and be concentric with the first protrusion portion and protrudes toward the one side of the washing tub;

a first recessed portion which is provided between the first and second protrusion portions and is recessed into the other side of the washing tub;

a third protrusion portion which is expanded to surround and be concentric with the second protrusion portion and protrudes toward the one side of the washing tub;

a second recessed portion which is provided between the second and third protrusion portions and is recessed into the other side of the washing tub; and plural drain holes positioned on at least a portion of the first and second recessed portions, wherein the distance between each of the plural drain holes in the first recessed portion is different in length from the distance between each of the plural drain holes in the second recessed portion.

2. The washing machine according to claim 1, wherein the protrusion portions protrude in an asymmetric shape.

3. The washing machine according to claim 2, wherein the protrusion portions protrude to be inclined in an edge direction of the washing tub.

4. The washing machine according to claim 1, wherein the plural drain holes are arranged on the first and second recessed portions which are recessed outward of the washing tub.

5. The washing machine according to claim 1, wherein the first and second recessed portions are provided in a planar form.

6. The washing machine according to claim 1, wherein the first and second recessed portions are provided in a curved surface form.

7. The washing machine according to claim 1, wherein the plural protrusion portions are provided in a circular shape.

8. The washing machine according to claim 1, wherein the plural protrusion portions are provided in a polygonal shape.

9. The washing machine according to claim 1, further comprising:

a lifter which protrudes from the inner surface of the washing tub such that the laundry is smoothly tumbled, wherein the lifter comprises an inflection portion in which a cross-sectional area at a central portion of the lifter is smaller than that at a distal portion thereof.

10. A washing machine comprising:

a main body;

a washing tub which is rotatably provided inside the main body and accommodates laundry;

a drive unit to rotate the washing tub;

protrusion portions protruding inward of the washing tub;

recessed portions configured to be recessed between the respective protrusion portions, plural drain holes being disposed in the recessed portion; and at least two patterns in which the protrusion portions and the recessed portions are alternately arranged and the protrusion portions and the recessed portions are arranged to have a concentric circular or concentric polygonal structure, wherein the distance between each of the plural drain holes is different in length in each of the respective recessed portions.

11. The washing machine according to claim 10, wherein a distance between the protrusion portions is increasingly narrowed as being away from a central portion of the concentric structure.

12. The washing machine according to claim 10, wherein a circumferential distance between the drain holes disposed at each recessed portion is increasingly widened farther from a central portion of the concentric structure.

13. The washing machine according to claim 10, wherein a radial distance between the protrusion portions is increasingly widened farther from a central portion of the concentric structure.

14. The washing machine according to claim 13, wherein a circumferential distance between the drain holes disposed at each recessed portion is increasingly narrowed farther from the central portion of the concentric structure.

15. The washing machine according to claim 10, wherein radial distances between the respective protrusion portions are equal to each other.

16. A washing machine comprising:

a main body;

a washing tub which is rotatably provided inside the main body and accommodates laundry;

a plurality of lifters protruding from an inner surface of the washing tub such that the laundry is tumbled; and at least two concentrically formed patterns provided in the washing tub and formed between the plural lifters, wherein each of the patterns comprises a first protrusion portion formed in a closed curve;

at least two second protrusion portions formed in at least two closed curves concentrically surrounding the first protrusion portion; and plural drain holes disposed between the first and at least two second protrusion portions, and wherein the distance between each of the plural drain holes is different in length between the first protrusion portion and one of the second protrusion portions, and the distance between each of the plural drain holes is different in length between the one of the second protrusion portions and an other of the second protrusion portions.

17. The washing machine according to claim 16, wherein each of the lifters comprises an inflection portion in which at least a portion of the lifter has a narrow width such that the lifter corresponds to shapes of the protrusion portions.

18. The washing machine according to claim 16, wherein an outermost one of the patterns further comprises a third protrusion portion at least a portion of which surrounds the at least two second protrusion portions and is bordered by the lifters.

19. The washing machine according to claim 16, wherein an outermost one of the patterns further comprises a third protrusion portion at least a portion of which surrounds the at least two second protrusion portions and is bordered by both ends of the washing tub.

* * * * *